US005279698A

United States Patent [19]

Davis

[11] Patent Number: 5,279,698

[45] Date of Patent: Jan. 18, 1994

[54] APPARATUS FOR SECURING A MAILING BROCHURE IN A FOLDED STATE

[76] Inventor: Gerald E. Davis, 31041 134th St., Princeton, Minn. 55371

[21] Appl. No.: 924,167

[22] Filed: Aug. 3, 1992

[51] Int. Cl.[5] ..... B65C 5/00

[52] U.S. Cl. ..... 156/483; 156/489; 156/542; 156/361

[58] Field of Search ..... 156/483, 484, 485, 541, 156/542, 361, 489, 493

[56] References Cited

U.S. PATENT DOCUMENTS

| | | | |
|---|---|---|---|
| 1,405,190 | 1/1922 | Durkee | 156/485 |
| 1,463,083 | 7/1923 | Hartman . | |
| 1,775,684 | 9/1930 | McKiernan . | |
| 1,954,971 | 4/1934 | Woodward | 229/92.1 |
| 2,119,371 | 5/1938 | Von Hofe | 156/487 |
| 2,168,525 | 8/1939 | Howard | 156/489 |
| 3,245,859 | 4/1966 | Busk | 156/479 |
| 3,680,772 | 8/1972 | Hoover | 229/79 |
| 3,813,268 | 8/1971 | Kerwin | 156/361 |
| 3,926,425 | 12/1975 | Pierce | 156/443 |
| 4,160,687 | 7/1979 | Spear | 156/444 |
| 4,453,990 | 6/1984 | Takahashi | 156/66 |
| 4,596,620 | 6/1986 | Karolyi | 156/216 |
| 4,648,930 | 3/1987 | La Mers | 156/247 |
| 4,840,698 | 6/1989 | Kuehnert | 156/485 |
| 4,904,333 | 2/1990 | Zoltner | 156/484 |
| 4,973,374 | 11/1990 | Karlyn | 156/541 |
| 5,022,954 | 6/1991 | Plaessmann | 156/542 |
| 5,069,738 | 12/1991 | Ruemeli et al. | 156/444 |
| 5,118,375 | 6/1992 | Malachowski | 156/443 |

FOREIGN PATENT DOCUMENTS

| | | | |
|---|---|---|---|
| 055846 | 8/1952 | France | 156/489 |

*Primary Examiner*—David A. Simmons
*Assistant Examiner*—Mark De Simone
*Attorney, Agent, or Firm*—Kinney & Lange

[57] ABSTRACT

A device for applying a fastening tab to an open edge of a folder mailing brochure to hold the brochure in a folded state including a feed mechanism, a drive assembly, and an application mechanism. The feed mechanism removes fastening tabs from a supply of fastening tabs and positions the fastening tabs relative to the application mechanism. The drive assembly is coupled to the feed mechanism and drives the feed mechanism. The application mechanism includes a pair of rotatable cylinders biased against each other. The supply of fastening tabs passes over the cylinders and when the open end of a folding mailing brochure is inserted into a gap between the cylinders, the cylinders act to apply a fastening tab over the open edge of the mailing brochure to secure the mailing brochure in a folded state.

15 Claims, 3 Drawing Sheets

APPARATUS FOR SECURING A MAILING BROCHURE IN A FOLDED STATE

BACKGROUND OF THE INVENTION

The present invention relates generally to apparatus for applying adhesive elements to objects. In particular, the present invention is a device for dispensing and applying an adhesive fastening tab to the open edge of folded mailing brochure to secure the brochure in a folded state for mailing.

Small clubs and organizations (often having less than 100 members) are frequent users of mailing brochures. Often, a newsletter (i.e., mailing brochure) usually composed of only a few sheets of paper containing information on upcoming events or other items of interest is periodically sent to group members. Typically, an envelope is not used. Instead, the newsletter is simply folded and secured in the folded state, and the address and stamp are applied directly to the folded newsletter. The predominant method of securing the newsletter in a folded state has been to staple the open end of the folded newsletter. Staples adequately secure the newsletter, but the sharp, raised edges of the staple may catch on automated postal machines, such as automatic canceling machines, and cause the machines to become obstructed. The use of an adhesive tab, instead of a staple, to secure the newsletter in a folded state avoids the problems caused by staples, but when compared to stapling, the application of the tab by hand is slow and cumbersome.

Devices for applying a strip of material over an edge of an object are generally known. U.S. Pat. No. 4,160,687 to Spear discloses one such device for applying a label across the open end of a magazine as the magazines are being conveyed across the apparatus at high speeds. A label is initially dispensed to stick to the rear edge of one cover of the magazine and extend outward beyond the edge of the magazine. A brush sweeps down to deflect the label across the pages of the magazine, and an air jet blows the label forward toward the opposite cover of the magazine. Finally, a second brush firmly applies the label to the opposite cover of the magazine thus completely securing the label from one cover across the loose pages to the other cover of the magazine. The device of Spear is primarily intended for large circulation mailings of relatively thick multipage magazines.

The U.S. Pat. No. 4,596,620 to Karoyli discloses an apparatus for covering a cut edge of a cardboard blank. The apparatus employs a folding and strip handling device having an upper part and a moveable bottom part which together form a slit. The moveable bottom part is biased towards the upper part by a spring. A cover strip is held by the folding device with the use of a negative pressure source. As a cardboard blank enters the slit, the cover strip is bent outwardly causing upper and lower ends of the strip to approach the blank. As the cardboard blank further enters the slit, surfaces of the upper and bottom parts push the upper and lower ends of the cover strip against upper and lower faces of the blank. The device of Karolyi is primarily intended to protect the cut edges of cardboard with a coating so materials do not penetrate the cardboard.

There is a need for an apparatus that can secure a mailing brochure in a folded state. Specifically, there is a need for an apparatus for use with small scale mailings of brochures of the type typically sent out by small clubs and organizations. This apparatus would allow the mailing brochures to be quickly readied (secured in a folded state) for mailing.

SUMMARY OF THE INVENTION

The present invention is a device for applying a fastening tab to an open edge of a folded mailing brochure to hold the brochure in a folded state (i.e., closed). The application device includes a support assembly. A support member is mounted to the support assembly and is adapted to hold a supply of fastening tabs. A feed mechanism is mounted to the support assembly and is designed to remove fastening tabs from the supply of fastening tabs. A drive assembly is mounted to the support assembly and is coupled to the feed mechanism. The drive assembly drives the feed mechanism. An application mechanism is mounted to the support assembly. The application mechanism includes a pair of rotatable cylinders biased against one another. The cylinders define a gap into which the open end of the folded mailing brochure can be inserted. The supply of fastening tabs passes over the gap created between the rotatable cylinders. Inserting a folded mailing brochure against a fastening tab and into the gap causes rotation of the cylinders, which act to apply the fastening tab over the open edge of the mailing brochure to fasten the open edge and thereby secure the mailing brochure in its folded state.

This application device is relatively uncomplicated. The device is ideally suited for securing mailing brochures of the type typically sent out by small clubs and organizations. Fastening tabs have previously been applied by hand without the aid of a machine which is time consuming and cumbersome. The application device makes application of fastening tabs to mailing brochures much faster and more convenient than applying the fastening tabs by hand. The use of a fastening tab to secure a mailing brochure in a folded states eliminates the need to use staples to secure the mailing brochure. Elimination of staples is advantageous because the protruding edges of staples may obstruct automated postal machines. Additionally, the application device is easy to operate.

DETAILED DESCRIPTION OF THE PREFERRED EMBODIMENTS

Figure 1:
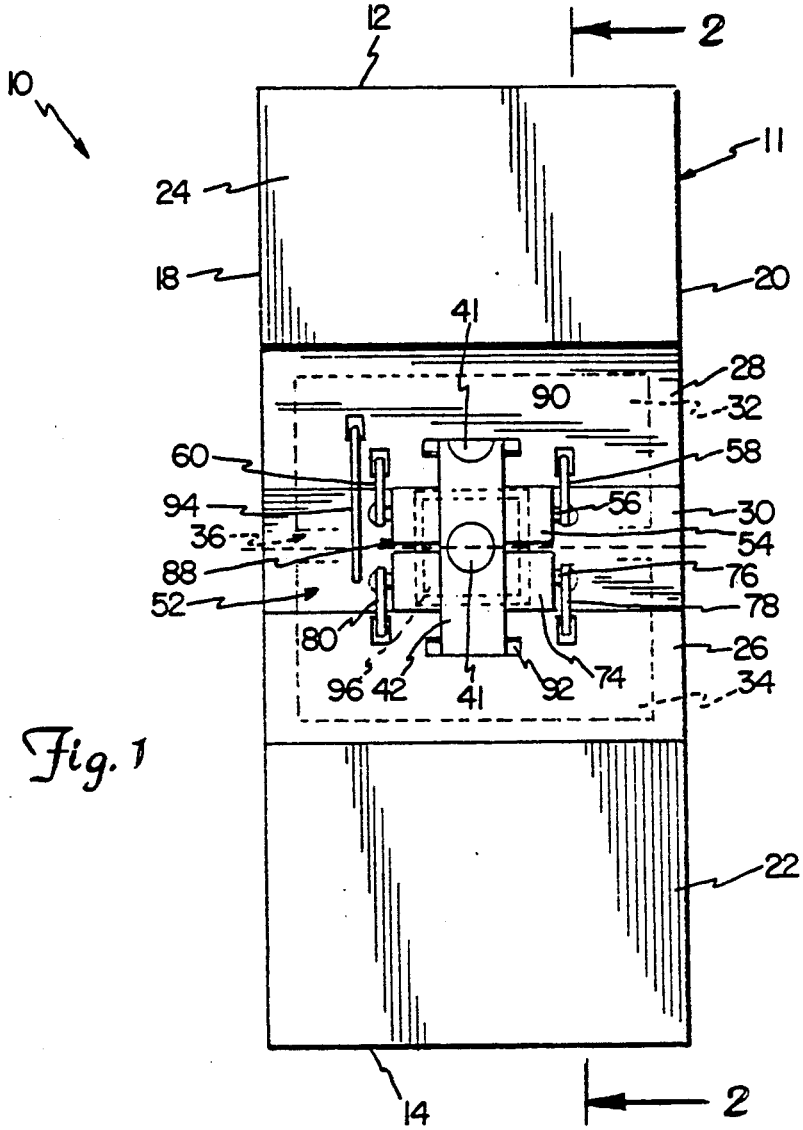
FIG. 1 is a front elevational view of an application device in accordance with the present invention with mailing brochure guide plates shown in phantom for clarity.
Figure 2:
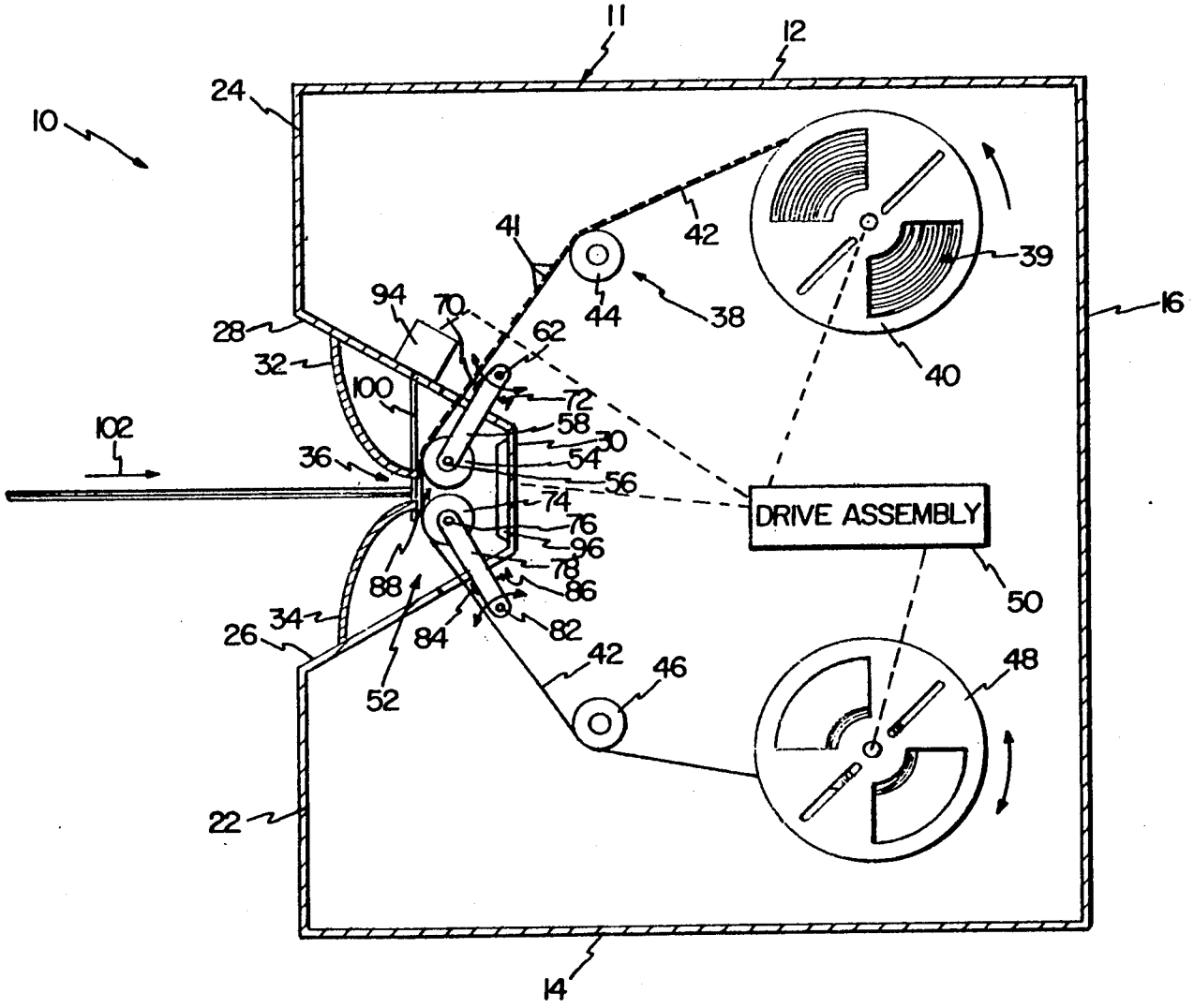
FIG. 2 is a sectional view taken along line 2—2 in FIG. 1 illustrating the interior components of the application device.

An application device 10 in accordance with the present invention is illustrated generally in FIGS. 1 and 2. The device 10 includes a support assembly 11 having a substantially rectangular parallelepiped shape (see FIGS. 1 and 2). The support assembly 111 is defined by a top plate 12, a bottom plate 14, a back plate 16, a left side plate 18, a right side plate 20, a lower front plate 22, an upper front plate 24, a lower angled front plate 26, an upper angled front plate 28, and a stop plate 30. As seen best in FIG. 2, the support assembly 11 further includes a curved upper guide plate 32 secured to the upper angled front plate 24 and a curved lower guide plate 34 secured to the lower angled front plate 26. Free ends of the upper and lower guide plates 32 and 34 define a horizontal channel 36.

As seen best in FIG. 2, the application device 10 includes a fastening tab supply system 38. The supply system 38 is mounted to the support assembly 11 and includes a supply of fastening tabs 39 on a support member, such as a rotatable supply spool 40. The supply of fastening tabs 39 includes fastening tabs 41 affixed to a backing material 42 by a releasable adhesive. The supply system 38 further includes a rotatable upper guide roller 44, a rotatable lower guide roller 46 and a feed mechanism, such as a take-up spool 48. The takeup spool 48 removes backing material 42 with fastening tabs 41 supported thereon from the supply of fastening tabs 39 on the supply spool 40. The supply spool 40 and take-up spool 48 are driven and controlled by a drive assembly 50. The drive assembly 50 controls the rate and direction of rotation of the supply and take-up spools 40 and 48.

Figure 3:
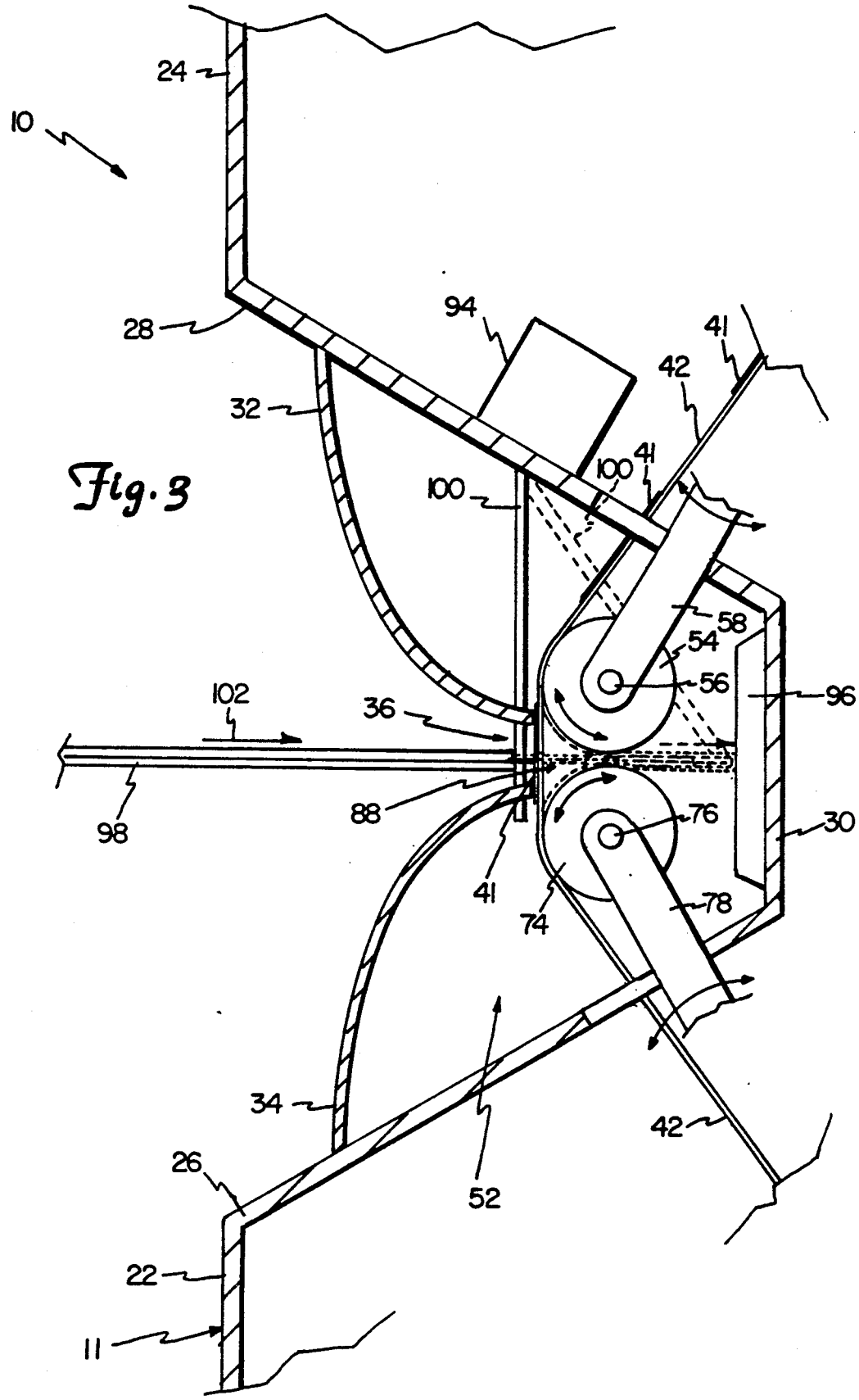
FIG. 3 is an enlarged sectional view similar to FIG. 2 further illustrating the particulars of the application device.

As seen in FIGS. 2 and 3, the application device 10 further includes an application mechanism 52. The application mechanism 52 includes an upper application cylinder 54 which is rotatably mounted on an upper axle 56 between an upper right pivot arm 58 and an upper left pivot arm 60 (see FIG. 1). The upper axle 56 passes through first ends of the upper right and left pivot arms 58 and 60. The upper right pivot arm 58 and the upper left pivot arm 60 are mounted pivotally at their opposite ends on an upper pivot member 62 to the support assembly 111. The upper pivot arms 58 and 60 are biased against upper stop blocks 70 (only one of which can be seen in FIG. 2) by upper springs 72 (only one of which can be seen in FIG. 2). Similarly, the application mechanism 52 includes a lower application cylinder 74 which is mounted axially on a lower axle 76 between a lower right pivot arm 78 and a lower left pivot arm 80. The lower axle 76 passes through first ends of the lower right and left pivot arms 78 and 80. The lower right pivot arm 78 and the lower left pivot arm 80 are mounted pivotally at their opposite ends on a lower pivot member 82 mounted to the support assembly 11. The lower right and left pivot arms 78 and 80 are biased against lower stop blocks 84 (only one of which can be seen in FIG. 2) by lower springs 86 (only one of which can be seen in FIG. 2).

The upper application cylinder 54 and the lower application cylinder 74 are positioned such that their axes are horizontal and aligned parallel and vertical with respect to each other. The upper application cylinder 54 and the lower application cylinder 74 are spaced such that there is a gap 88 between the surface of the upper application cylinder 54 and the surface of the lower application cylinder 74.

The guide rollers 44 and 46 and the application cylinders 54 and 74 are positioned such that the backing material 42 is directed from the supply spool 40 over the guide roller 44, through an upper supply slot 90 in the upper angled front plate 28, over the application cylinders 54 and 74, through a lower supply slot 92 in the lower angled front plate 26, around guide roller 46 and onto the take-up spool 48.

Operation of the drive assembly 50 is controlled by a front trip switch 94 and a rear trip switch 96. The front trip switch 94 is positioned adjacent the application cylinders 54 and 74 such that insertion of a folded mailing brochure 98 through the horizontal channel 36, as directed by the guide plates 32 and 34, and into the gap 88 moves a lever arm 100 of the front trip switch 94. This procedure activates the front trip switch 94 and causes the fastening tab supply system 38 to release a measured amount of the backing material 42. The back trip switch 96 is positioned on the stop plate 30 such that complete insertion of the folded mailing brochure 98 activates the back trip switch 58 and causes the fastening tab supply system 36 to advance the backing material 42 so that the next fastening tab 41 is positioned at the gap 88.

The application device 10 operates as follows: The folded mailing brochure 98 is moved towards the channel 36 in the direction of arrow 102. The upper and lower guide plates 32 and 34, respectively, direct the folded mailing brochure 98 into the gap 88. As the folded mailing brochure 98 approaches the application cylinders 54 and 74, the brochure 98 strikes the lever arm 100 of the front trip switch 94, thereby signaling the drive assembly 50 to release a measured amount of the backing material 42. The supply spool 40 and the take-up spool 48 release an equal amount of backing material 42. The released backing material 42 being long enough to enable the folded mailing brochure 98 to be inserted fully against the back trip switch 96.

Figure 4:
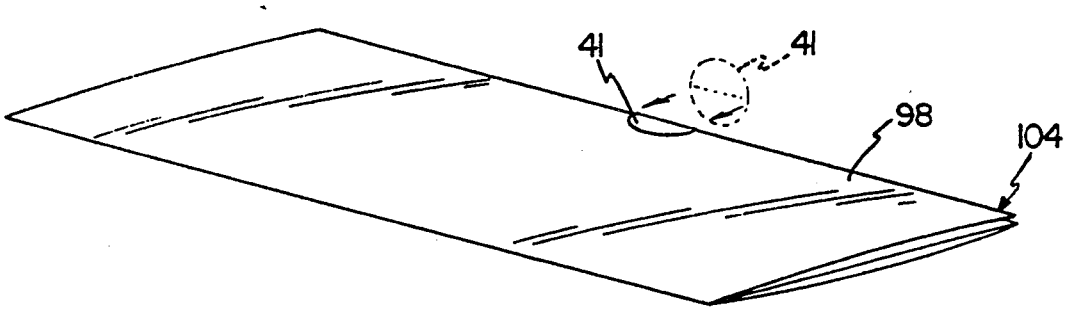
FIG. 4 is a perspective view of a folded mailing brochure secured in a folded state by a fastening tab (shown in solid lines) applied to the brochure by the application device in accordance with the present invention.

As the folded mailing brochure 98 continues to advance in the direction of arrow 102, an open end 104 (see FIG. 4) of the 98 contacts the fastening tab 41 that is centered over the gap 88. As the folded mailing brochure 98 advances the backing material 42 and the attached fastening tab 41 are pushed into the gap 88, and the fastening tab 41 begins to fold around the open end 104 of the brochure 98. As the folded mailing brochure 98 is pressed against the fastening tab 41, positioned in front of the gap 88, and the backing material 42, the tension on the backing material 42 forces the upper and lower pivot arms 58, 60, 78, and 80 to pivot about the upper and lower pivot members 62 and 82. The upper and lower springs 72 and 82, respectively, are compressed, and the application cylinders 54 and 74 approach each other. As the application cylinders 54 and 74 continue to approach one another, the application cylinders 54 and 74 pinch the folded mailing brochure 98, the fastening tab 41, and the backing material 42, thereby causing the fastening tab 41 to adhere to the folded mailing brochure 98 about the open end 104.

When the folded mailing brochure 98 is fully inserted and strikes the back trip switch 96, the drive assembly 50 rotates the take-up spool 42 and advances the backing material 42 so that the next fastening tab 41 is centered over the gap 88 between the upper application cylinder 54 and the lower application cylinder 74. At the same time, the folded mailing brochure 98 is withdrawn from the gap 88 and the upper and lower application cylinders 54 and 74, respectively, are returned to their original positions by the upper and lower springs 72 and 82 against the upper and lower stop blocks 70 and 84. The application device 10 is then ready for the insertion of the next folded mailing brochure 98 wherein the above described process is repeated.

This application device 10 is relatively uncomplicated. The device 10 is ideally suited for securing folded mailing brochures 98 of the type typically sent out by small clubs and organizations. The application device 10 makes application of fastening tabs 41 to folded mailing brochures 98 much faster and more convenient than applying the fastening tabs by hand. The use of the fastening tabs 41 to secure folded mailing brochures 98 in a folded state eliminates the need to use staples to secure a folded mailing brochure. Additionally, the application device 10 is easy to operate.

Although the present invention has been described with reference to preferred embodiments, workers skilled in the art will recognize that changes may be made in form and detail without departing from the spirit and scope of the invention.

What is claimed is:

1. A device for applying a fastening tab to an open edge of a folded mailing brochure to hold the brochure in a folded state, the apparatus comprising:

a support assembly;

a support member mounted to the support assembly for holding a supply of fastening tabs;

a feed mechanism mounted to the support assembly for removing fastening tabs from the supply of fastening tabs;

a drive assembly mounted to the support assembly and coupled to the feed mechanism, the drive assembly driving the feed mechanism; and an application mechanism mounted to the support assembly, the application mechanism including:

a pair of rotatable cylinders over which the supply of fastening tabs passes, the cylinders defining a gap into which an open end of a folded mailing brochure can be inserted, and means connecting the rotatable cylinders to the support assembly for allowing the cylinders to move relative to one another, such that insertion of an open end of a folded mailing brochure into the gap causes movement of the cylinders toward one another and rotation of the cylinders which act to apply a fastening tab over an open edge of a mailing brochure to fasten the open edge to secure the mailing brochure in a folded state.

2. The application device of claim 1 wherein the supply of fastening tabs includes a roll containing a continuous length of backing material upon which the fastening tabs are supported.

3. The application device of claim 2 wherein one face of the fastening tabs are secured to the backing material by an adhesive, and the reverse face of the fastening tabs are covered by an adhesive to secure the fastening tab to the mailing brochure, the adhesive securing the fastening tabs to the backing material being weaker than the adhesive securing the fastening tabs to the mailing brochures, thus allowing the fastening tabs to separate from the backing material when the fastening tabs are applied to the mailing brochures.

4. The application device of claim 2 wherein the drive assembly includes a sensor, such that actuation of the sensor causes the feed mechanism to release a measured amount of backing material.

5. The application device of claim 4 wherein the measured amount of backing material is a length equal to the distance required to advance the supply of fastening tabs to the next fastening tab.

6. The application device of claim 4 wherein the sensor is activated via the insertion of a mailing brochure into the gap between the rotatable cylinders.

7. The application device of claim 1 wherein the feed mechanism includes guide rollers to limit the movement of the fastening tabs in a direction parallel to axes of the rotatable cylinders, and to direct the movement of the fastening tabs past the rotatable cylinders.

8. The application device of claim 1 wherein the drive assembly includes a sensor such that actuation of the sensor causes the feed mechanism to advance the supply of fastening tabs to the next fastening tab.

9. The application device of claim 8 wherein the sensor is activated via the completed insertion of a mailing brochure into the gap between the pair of rotatable cylinders.

10. The application device of claim 1 wherein the support member is a supply spool that holds a continuous supply of backing material upon which the fastening tabs are releasably supported.

11. The application device of claim 1 wherein the feed mechanism includes a take-up spool to collect the backing material after the fastening tabs have been applied to the mailing brochures.

12. The application device of claim 1, and further including a guide assembly to guide the open edge of the mailing brochure into the gap between the rotatable cylinders.

13. The application device of claim 12 wherein the guide assembly includes a first guide plate positioned with one edge closely spaced parallel and slightly above the gap between the rotatable cylinders, and a second guide plate with one edge closely spaced parallel and slightly below the gap between the rotatable cylinders, the first and second guide plates together forming a V-shape to guide the mailing brochure into the gap between the rotatable cylinders.

14. The application device of claim 1 wherein the mailing brochure is inserted manually.

15. The application device of claim 1 wherein the connecting means includes a biasing means for biasing the rotatable cylinders away from each other.

* * * * *